US006649892B2

(12) United States Patent
Linn et al.

(10) Patent No.: US 6,649,892 B2
(45) Date of Patent: Nov. 18, 2003

(54) MICROWAVE OVEN SYSTEM

(75) Inventors: Horst Linn, Eschenfelden (DE); Juergen Suhm, Eschenfelden (DE)

(73) Assignee: Linn High Term GmbH, Eschenfelden (DE)

( * ) Notice: Subject to any disclaimer, the term of this patent is extended or adjusted under 35 U.S.C. 154(b) by 0 days.

(21) Appl. No.: 10/324,299

(22) Filed: Dec. 19, 2002

(65) Prior Publication Data

US 2003/0121914 A1 Jul. 3, 2003

(30) Foreign Application Priority Data

Dec. 28, 2001 (DE) ..... 101 64 299

(51) Int. Cl.[7] ..... H05B 6/72

(52) U.S. Cl. ..... 219/761; 219/756; 219/746; 315/39.51

(58) Field of Search ..... 219/761, 756, 219/746, 748, 715, 717, 678; 315/39.51, 39.65

(56) References Cited

U.S. PATENT DOCUMENTS 3,494,722 A 2/1970 Gray
3,934,566 A * 1/1976 Ward ..... 219/686
4,746,968 A 5/1988 Wear et al.

FOREIGN PATENT DOCUMENTS

| | | |
|---|---|---|
| DE | 1818464 | 7/1960 |
| DE | 43 28 086 | 2/1995 |
| DE | 196 43 989 | 5/1997 |
| GB | 2 035 676 * | 6/1980 |

* cited by examiner

*Primary Examiner*—Philip H. Leung
(74) *Attorney, Agent, or Firm*—Fulbright & Jaworski L.L.P.

(57) ABSTRACT

In a microwave oven system comprising at least one magnetron of a given operating frequency and a mains unit for the at least one magnetron, the at least one magnetron of a given operating frequency is replaceable by a magnetron of another operating frequency. The magnetrons of the different operating frequencies have at least approximately the same mechanical dimensions so that they can be easily replaced quickly. The mains unit can be used for the different magnetrons in unchanged form or in a form involving minor modifications, without any change in the electrical parameters or with a slight change therein, thereby affording interchangeability of the various magnetrons.

4 Claims, 1 Drawing Sheet

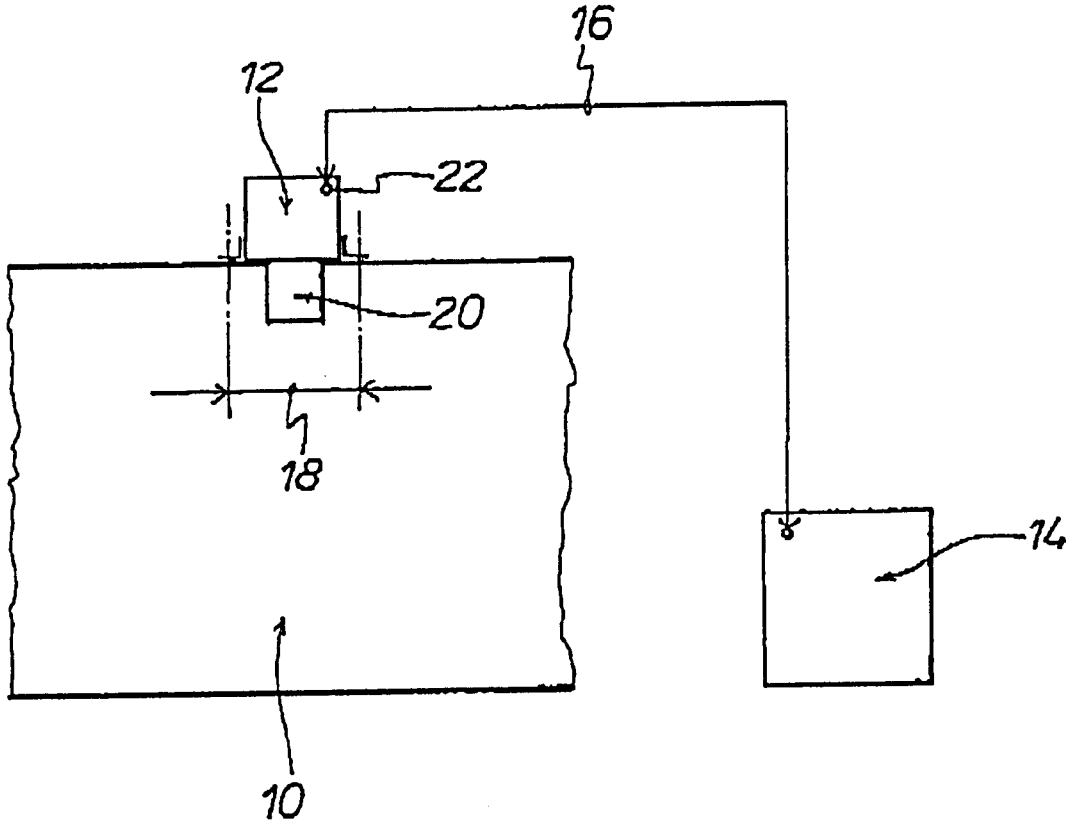
16
12
22
20
18
14
10

MICROWAVE OVEN SYSTEM

This application claims the benefit of the filing date of German Patent Application No. 101 64 299.7 filed on Dec. 28, 2001 pursuant to 35 U.S.C. 119 and the Paris Convention.

FIELD OF THE INVENTION

The invention concerns a microwave oven system.

BACKGROUND OF THE INVENTION

Microwave ovens which may be for example in the form of chamber-type ovens, through-type or continuous ovens and the like are usually operated by means of at least one magnetron or a number of magnetrons, operating at a given frequency. The frequency involved is usually 2.5 GHz. The operating frequency may also be for example 915 MHz.

Crucial factors in regard to the heating output power produced in an element of volume of a material to be heated in a microwave oven are the electrical field strength E of the microwave field, the operating frequency f, the loss factor tan δ and the relative dielectric constant ϵ. The following applies in regard to the volume power density P:

$$P=2\pi f\cdot\epsilon\cdot\tan\delta\cdot E^2.$$

The volume power density is therefore proportional to the operating frequency of the at least one magnetron used in the microwave oven.

German utility model No 1 818 464 describes a microwave oven of through-flow type with an elongate working chamber which is closed at all sides in respect of high frequency and with a conveyor belt extending through the working chamber for the material to be treated in the microwave oven. During its transportation movement through the oven the material passes successively through various microwave fields at different frequencies. It will be appreciated that this is a through-flow oven having a plurality of magnetrons operating at different frequencies in the direction of transportation movement of the material to be treated in the oven.

Consideration may be given to U.S. Pat. No. 3,494,722 disclosing a method and an apparatus for sterilisation by means of microwave radiation. In that case the microwave radiation can be at a wavelength in a range of between 0.9 and 17 GHz. A preferred wavelength is between 2.36 and 2.9 GHz, the usual operating frequency being 2.45 GHz.

U.S. Pat. No. 4,746,968 describes an apparatus for drying material by means of microwave radiation in combination with infrared radiation. The microwave radiation has for example an operating frequency of 2.54 GHz or 915 MHz.

DE 196 43 989 A1 discloses an apparatus for treating substances with electromagnetic high-frequency energy. That apparatus operates with magnetrons having an operating frequency of between about 100 MHz and 10 GHz, being supplied from mains units with a low degree of ripple or pulsation. In particular the apparatus involves the use of a microwave device, that is to say a magnetron, operating at a frequency of 2.45 GHz.

In all the known microwave furnace systems outlined above the or each respective magnetron has a given operating frequency in order to achieve the respectively desired heating power and activity.

SUMMARY OF THE INVENTION

An object of the present invention is to provide a microwave oven system which affords a high level of operational versatility without involving structural complications.

Another object of the present invention is to provide a microwave oven system in which it is very easily possible to alter the heating power as desired without the need for major electrical and/or mechanical changes at the microwave oven or peripheral equipment thereof such as a mains unit.

In accordance with the principles of the invention the foregoing and other objects are attained by a microwave oven system comprising at least one magnetron which has given electrical operating parameters such as anode voltage, heating voltage and heating current, and a mains unit for the at least one magnetron. The at least one magnetron of a given operating frequency is replaceable by a magnetron of another operating frequency. The magnetrons of the various operating frequencies are of at least similar or identical mechanical mounting dimensions. The mains unit can be used unchanged for the various magnetrons of different operating frequencies without a change in the electrical operating parameters. It will be noted that very minor alterations may possibly be required, in which respect the essential components of the system such as the heating and high-voltage transformers are retained unchanged.

In accordance with the invention therefore it is advantageously possible for example to replace a magnetron operating at a frequency of 2.45 GHz by a magnetron and launcher of an operating frequency of 915 MHz or 5.8 GHz in order to achieve the respectively desired heating effect. In that situation the respective magnetron and launcher only need to be simply removed from the microwave oven and replaced by the respectively desired other magnetron. As the magnetrons involving the different operating frequencies are of at least substantially the same mechanical dimensions, replacement of a magnetron of a given operating frequency by a magnetron of another frequency can be effected easily and without taking up a great deal of time. A microwave oven system in accordance with the invention therefore enjoys for example the advantage that, in the case of an existing microwave oven with magnetrons for example of an operating frequency of 2.45 GHz, those magnetrons can be replaced by magnetrons for example of an operating frequency of 5.8 GHz. The user of an already existing microwave oven therefore does not have to procure a different new microwave oven if he requires a different heating power, but he only needs to replace the existing magnetrons by magnetrons which involve the appropriate operating frequency. A quite considerable advantage in that respect is also that the mains unit of the existing microwave oven does not need to be replaced, but the existing mains unit can still continue to be used without change or only a few components are required for adaptation purposes in that respect.

In accordance with the invention it is possible for the at least one magnetron to be provided on the corresponding microwave oven directly, that is to say without a further microwave coupling device. If for example the at least one magnetron is combined with a coupling device it has then proven to be desirable in the microwave oven system according to the invention if the magnetrons of the various operating frequencies are combined with respectively associated microwave coupling devices. This means that, when replacing a unit consisting of a magnetron involving a given operating frequency and the associated microwave coupling device thereof, that unit is removed from the microwave oven and another unit consisting of a different magnetron with its associated microwave coupling device can then be easily fitted to the microwave oven. That procedure is simple and does not take up a great deal of time.

Further objects, features and advantages of the present invention will be apparent from the description of a preferred embodiment hereinafter.

BRIEF DESCRIPTION OF THE DRAWING

The single FIGURE of the drawing shows an embodiment in highly diagrammatic form of a microwave oven system according to the invention.

DESCRIPTION OF THE PREFERRED EMBODIMENT

The FIGURE shows therein a part of a microwave oven which is generally identified at 10 and on which there is provided at least one magnetron as shown at 12. The microwave oven 10 is for example a chamber oven or an oven of through type, without however being restricted thereto. The magnetron 12 is connected to a mains unit 14 by a line shown at 16.

The magnetron 12 has given electrical operating parameters. These are for example the anode voltage of the magnetron 12, its heating voltage and its heating current. In the present case and by way of example the anode voltage is 4 kV, the heating voltage is 3.3 V and the heating current is 10.5 A. The magnetron 12 produces for example an output power of 800 W.

The magnetron 12 is of a given operating frequency. The microwave oven system according to the invention is designed to selectively use magnetrons 12 of different operating frequencies but which are each of at least substantially identical mechanical fitting dimensions. This is indicated in the FIGURE by the double-headed arrow 18. By virtue of the fact that the magnetrons 12 of the different operating frequencies have at least substantially identical mechanical dimensions 18, it is easily possible, without involving a great deal of time, to replace a fitted magnetron 12 of a given operating frequency as desired by a magnetron 12 of a different frequency.

The magnetrons 12 of the different operating frequencies each involve the same electrical operating parameters such as anode voltage, heating voltage and heating current, as indicated above, so that the magnetrons 12 of the different operating frequencies can be operated with one and the same mains unit 14, or only minor alterations are required, which can be implemented with few components.

In the system illustrated in the FIGURE the magnetron 12 involving the respective defined operating frequency is combined with a microwave coupling device diagrammatically indicated at 20. In that case the respective magnetron 12 of a given operating frequency and the microwave coupling device 20 combined therewith form a unit, in which respect it will be appreciated that the microwave coupling devices 20 of the magnetrons 12 of the different operating frequencies may be correspondingly differently dimensioned. The mechanical dimensions 18 of the respective unit consisting of the magnetron 12 and its microwave coupling device 20 are however the same for the various magnetrons 12 of different operating frequencies. In addition components such as fans, transformers and monitoring systems remain the same without any change so that it is advantageously only necessary to release the respective connecting contact 22 by means of which the mains unit 14 is connected to the respective magnetron 12 involving a given operating frequency, and for the respective magnetron 12 which is fitted to the microwave to be replaced by the desired different magnetron 12 involving a different operating frequency. Under some circumstances minor adaptive modifications may be required, but in that case few additional components are necessary. The essential components of the system such as for example the heating and high-voltage transformers remain unchanged.

It will be seen from the foregoing description of a preferred configuration of the invention that the microwave oven system according to the invention is advantageous both from the point of view of a desired change in power and also from the point of view of optimum retrofit capability.

It will be further appreciated that the above-described embodiment of the microwave oven system according to the invention has been set forth solely by way of example and illustration of the principles of the invention and that various modifications and alterations may be made therein without thereby departing from the spirit and scope of the invention.

What is claimed is:

1. A microwave oven system comprising at least one magnetron which has given electrical operating parameters, and a mains unit for the at least one magnetron, wherein the at least one magnetron of a given operating frequency is replaceable by a magnetron of another operating frequency, wherein the magnetrons of the various operating frequencies are of at least substantially the same mechanical dimensions and wherein the mains unit can be used at least substantially unchanged for the various magnetrons of the different operating frequencies without a change in the electrical operating parameters.

2. A microwave oven system as set forth in claim 1 wherein the electrical operating parameters are anode voltage, heating voltage and heating current.

3. A microwave oven system as set forth in claim 1 including microwave coupling means operatively combined with the respectively associated magnetrons of the various operating frequencies.

4. A microwave oven system comprising a microwave oven, a plurality of magnetrons for respective selective use in the microwave oven and which each have the same electrical operating parameters consisting of anode voltage, heating voltage and heating current, but different operating frequencies, and a mains unit for selectively powering the magnetron fitted to the microwave oven, wherein the magnetrons of the different operating frequencies are of at least substantially the same mechanical fitting dimensions, the arrangement being such that the mains unit can be used unchanged for the various magnetrons of the different operating frequencies without a change in said electrical operating parameters.

* * * * *